United States Patent [19]

Hammarlund

[11] Patent Number: 4,591,059

[45] Date of Patent: May 27, 1986

[54] RAILROAD CAR DRAFT GEAR ASSEMBLY WITH FRICTION BORE WEAR LINERS

[75] Inventor: Richard C. Hammarlund, Wasco, Ill.

[73] Assignee: Miner Enterprises, Inc., Geneva, Ill.

[21] Appl. No.: 641,626

[22] Filed: Aug. 17, 1984

[51] Int. Cl.[4] ..... B61G 9/18

[52] U.S. Cl. ..... 213/32 R; 213/24; 267/9 A

[58] Field of Search ..... 213/22, 24, 31, 32 R, 213/32 A, 32 B, 34, 37, 61; 267/9 R, 9 A; 308/DIG. 8, DIG. 9; 105/225; 72/373; 29/DIG. 49

[56] References Cited

U.S. PATENT DOCUMENTS

| | | | |
|---|---|---|---|
| 981,790 | 1/1911 | O'Conner | 213/32 R |
| 2,079,845 | 5/1937 | Eastburg | 105/225 |
| 2,159,457 | 5/1939 | Sproul | 213/32 R |
| 2,475,670 | 7/1949 | Lounsbury | 213/22 |
| 2,540,561 | 2/1951 | Williams | 267/9 A |
| 2,667,277 | 1/1954 | Mulcahy | 213/32 R |
| 2,703,297 | 3/1955 | MacLeod | 29/DIG. 49 |
| 3,348,633 | 10/1967 | Allan | 213/32 R |
| 4,194,794 | 3/1980 | Kling | 308/DIG. 8 |

*Primary Examiner*—David A. Scherbel
*Assistant Examiner*—Dennis C. Rodgers

[57] ABSTRACT

A draft gear assembly to cushion and absorb impacting forces on a railroad car coupler system includes a housing containing a spring package. Through a follower the spring package interacts with a set of friction shoes. The shoes are positioned in friction shoe seats in a friction bore section of the housing. Each seat includes a wear liner in a recess formed on an inner surface of the housing friction bore section. The shoes in turn engage a wedge which extends from the housing to connect with other elements of the coupler system. The liners are made of a selective steel initially deformed by the impacting forces. This deformable quality allows wider dimensional variations between the shoes, liners, and the housing recesses. After deformation the liners fit properly in the recesses and the shoes in the seats to optimize areas of contact therebetween. During subsequent operation of the car the impacting forces work harden the liners to a level selectively less than the hardness of the shoes to further increase wear resistance. Because the liners may be readily removed and replaced, a useful life of the housing may be extended indefinitely.

9 Claims, 9 Drawing Figures

RAILROAD CAR DRAFT GEAR ASSEMBLY WITH FRICTION BORE WEAR LINERS

BACKGROUND OF THE INVENTION

1. Field of the Invention

This invention relates to railroad car coupler systems and more particularly to draft gear assemblies for such systems where the assembly includes replaceable friction bore wear liners to interact with friction shoes of the assembly.

2. Prior Art

Coupler systems for modern railroad cars typically include a draft gear assembly to cushion and absorb forces placed on the system during car operation. Means to cushion and absorb such forces may comprise a spring package connecting with a frictional restraint device. This frictional restraint device in turn may include a set of friction shoes positioned in friction shoe seats formed in a friction bore section of a housing of the assembly. The impacting force is absorbed by friction between the shoes and friction shoe seats during shoe movement which movement also acts to compress the spring package.

Similar cushioning and absorbing means are used in other railroad component systems, for example between a bolster and a side frame of a car truck and in connection with a bolster center plate.

Some earlier frictional restraint devices had shoes which interacted with wear liners rather than directly with a housing of the device. In recent times use of such liners has been largely discontinued because of manufacturing difficulties.

One early example of a frictional restraint device and spring package used in connection with a locomotive truck center plate is disclosed in U.S. Pat. No. 2,151,603. A series of coil springs connect with a pair of friction shoes. The shoes slideably engage a pair of liners in sliding contact with an inside of a casing. During travel of the railroad locomotive, for example about a curved section of track, the trucks tend to move apart. This movement is transferred to the springs through the friction shoes and regulated accordingly.

A further railroad car shock absorbing device is set forth in U.S. Pat. No. 2,624,567. This device has a wedge which during inward movement forces a set of friction shoes apart to slide compressively over adjacent side portions of a set of wear liners positioned between the shoes. This inward shoe movement is restrained by compression of a spring and friction between the shoes and liner side portions.

SUMMARY OF THE INVENTION

A draft gear assembly particularly useful in a railroad car coupler system to absorb and cushion impacting forces placed on the system during car operation includes a hollow, cast housing. Within the housing is a spring package compressively held between a housing end wall and a follower. The follower is in contact with a set of friction shoes positioned in friction shoe seats in a friction bore section of the housing. These seats comprise wear liners carried respectively in recesses formed on inner surfaces of sidewalls of the housing friction bore section. The shoes in turn have sloped walls in contact with complementarily formed wedging surfaces on a wedge. The wedge extends from the housing for engagement with a shank of the coupler system.

The wear liners have metallurgical properties such that during initial assembly use the shoes deform the liners to increase an area of contact between the shoes and the liners and between the liners and the housing recesses respectively. As use continues, the impacting forces of the assembly work harden the liners to a level selectively less than that of the shoes.

The draft gear assembly of this invention provides several advantages over known gear assemblies.

First, use of friction shoe liners allows selection of material best suited for the particular requirements of that component. For example, since the housing and the shoes are cast, a material ideally suited for this manufacturing procedure may be so chosen. As cast in a green sand mold, these components cannot be made to have tight dimensional tolerances. These dimensional variations, however, do not prevent a proper fit between the shoe and wear liner and between the wear liner and recess. Deformation of the liner provides the needed fit.

Thus, the actual recess size need not be controlled by use of precision casting techniques nor the housing made with properties to facilitate machining. Liner deformation insures that interaction between the shoe and liner occurs over a substantial surface area and that the liner remains properly positioned in the recess during subsequent car operation. Increasing the area of engagement decreases the rate of wear accordingly.

A still further advantage of this invention results from having the liners work hardenable to a level selectively less than a hardness level of the shoes. By maintaining a hardness level differential at about 100 Brinell points, for example, adhesive wear between the shoes and liners is minimized. Thus, the useful life of each is further extended.

Lastly, a draft gear assembly of this invention may be more readily and inexpensively reconditioned since worn wear liners may be removed and replaced without a need for extensive repair of the assembly housing. If properly maintained, the useful life of the housing may be extended indefinitely since no portion of the housing is subject to a direct wearing action.

DESCRIPTION OF THE PREFERRED EMBODIMENT

Figure 1:
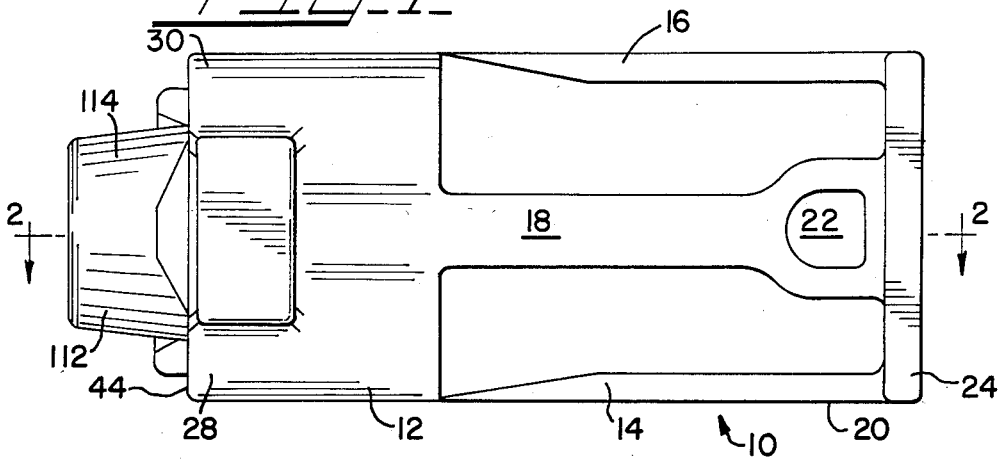
FIG. 1 is a side elevation view of a railroad car draft gear assembly of this invention.
Figure 2:
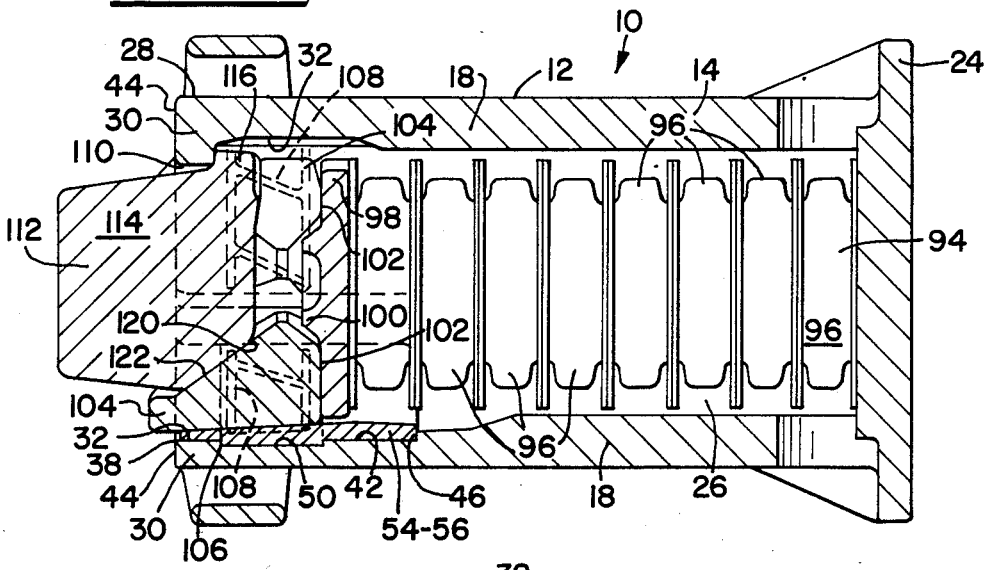
FIG. 2 is a plan view in section as seen generally along the line 2—2 of FIG. 1.
Figure 3:
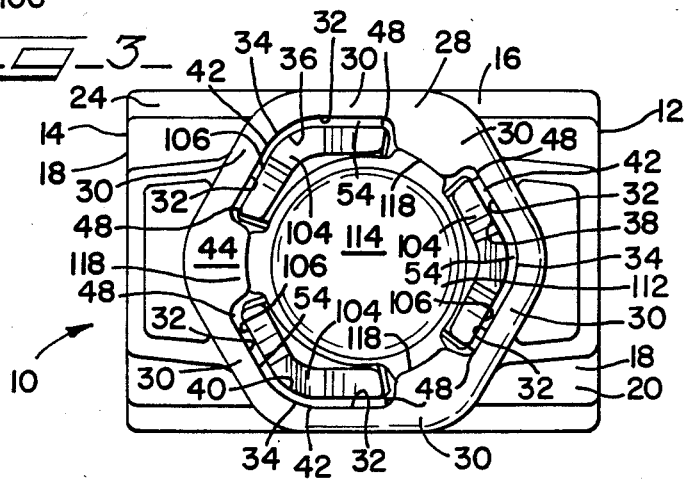
FIG. 3 is a front elevation view of the draft gear assembly of FIG. 1.

A draft gear assembly for a railroad car coupler system is shown generally in FIG. 1–3 and designated 10. As appreciated by those familiar with railroad car construction, such assemblies are used to absorb and cushion impacting forces placed on the coupler system during car operation. Typically, the gear assembly 10 is positioned in a yoke (not shown) which in turn is carried in a sill (not shown) of a body of a railroad car (not shown).

The draft gear assembly 10 includes a housing 12 having a hollow inner section 14 defined by a top wall 16, a pair of spaced apart sidewalls 18 and a bottom wall 20. The housing 12 typically is made as a casting in a green sand mold and as such includes several openings, for example an opening 22. Openings such as 22 reduce the weight of the housing 12 and aid in core removal after the cast metal has solidified. The housing inner section 14 is closed by an end wall 24 to define an interior space 26.

Connecting with the housing inner section 14 is an outer friction bore section 28. This outer section 28 is defined by six connecting sidewalls 30 positioned in a hexagon array. Adjacent pairs of inner surfaces 32 of the sidewalls 30 connect at radius corners 34 to form in part three friction shoe seats 36, 38, and 40.

Each friction shoe seat 36–40 includes a recess 42 which extends from a front wall 44 of the friction bore section 28 to terminate at an inner circumferential shoulder 46 located adjacent to the housing inner section 14. Each recess 42 is further defined by a pair of spaced apart longitudinal sides 48. Located approximately midway between the front wall 44 and recess inner shoulder 46 is a cutout 50, see FIG. 2.

Figure 4:
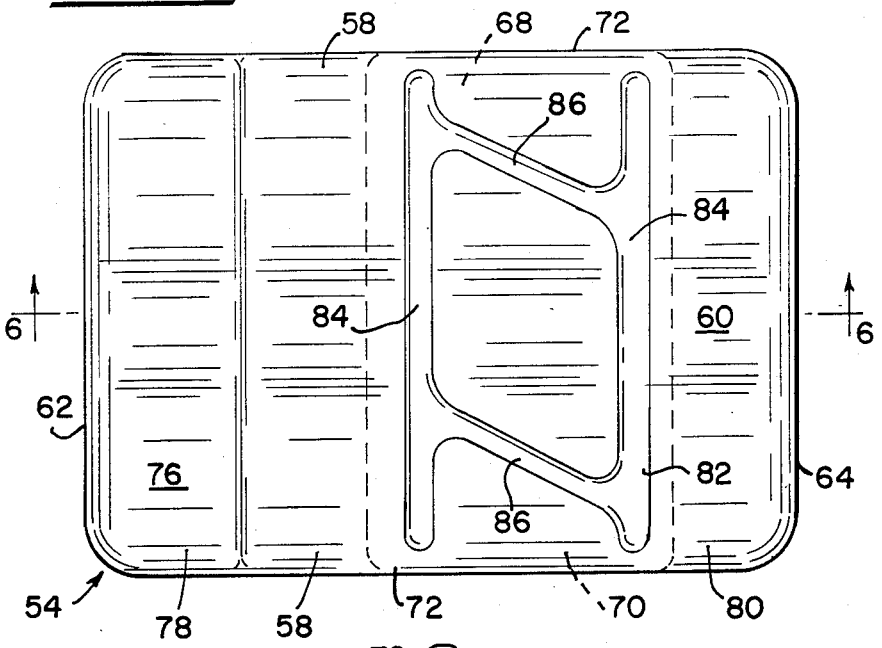
FIG. 4 is a plan view of an inner face of a wear liner for the gear assembly of FIG. 1.
Figure 5:
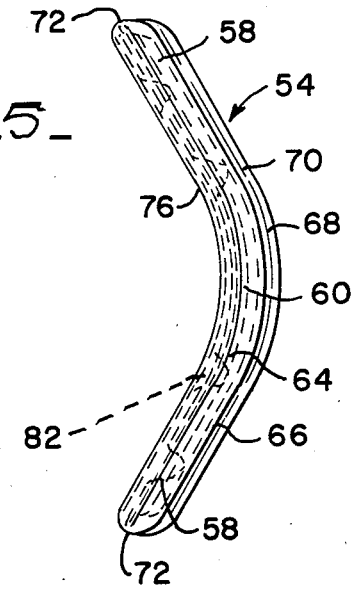
FIG. 5 is an end elevation view of the wear liner of FIG. 4.
Figure 6:
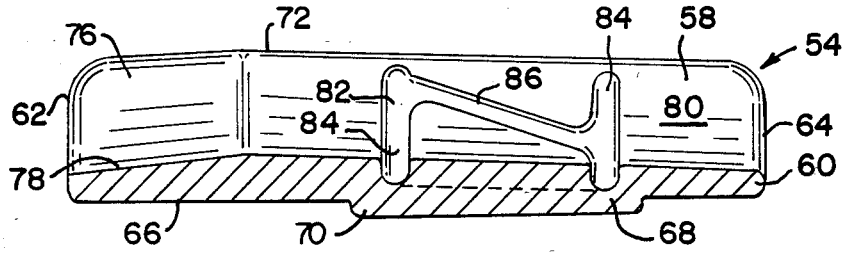
FIG. 6 is a cross sectional view as seen generally along the line 6—6 of FIG. 4.
Figure 7:
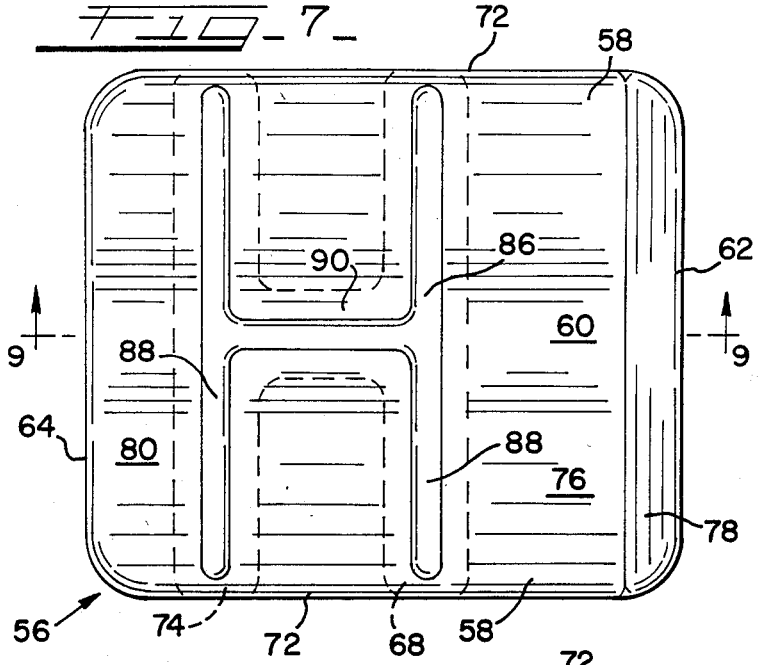
FIG. 7 is a plan view of an inner face of a further wear liner for the gear assembly of FIG. 1.
Figure 8:
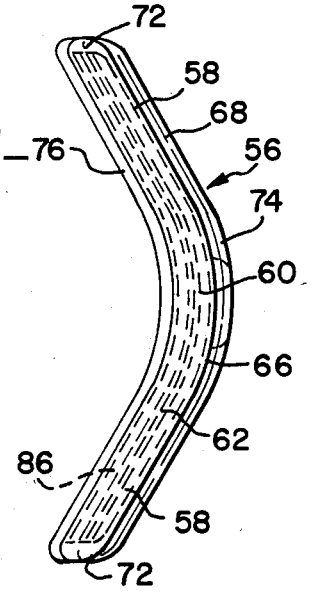
FIG. 8 is an end elevation view of the wear liner of FIG. 7.
Figure 9:
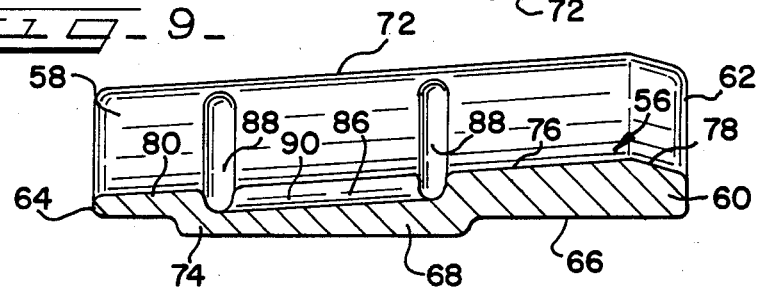
FIG. 9 is a cross sectional view as seen generally along the line 9—9 of FIG. 7.

In each recess 42 is a wear liner. A preferred liner is shown in detail in FIGS. 4, 5 and 6 and identified by reference number 54. Another wear liner is shown in FIGS. 7, 8 and 9 and designated 56. The wear liners 54, 56 are similar in many respects and like reference numbers are used to identify similar structure. Each liner 54, 56 has a shallow V-like configuration defined by side portions 58 which connect with a central radiused portion 60. These portions 58, 60 extend between an inner edge 62 and an outer edge 64.

On an outer face 66 of the liners 54, 56 is a raised area 68. The raised area 68 on the wear liner 54 is in the form of a peripheral rib 70 which extends between side edges 72. The raised area 68 on the wear liner 56 is a H-like shaped projection 74. The recess cutout 50 of the housing friction bore section 28 therefore is formed as a continuous groove for the wear plate 54 or in the shape of a "H" for the wear liner 56.

An outer face 76 of the liners 54, 56 includes a relief segment 78 positioned adjacent to the inner edge 62 and a wear surface portion 80 which tapers from the relief segment 78 to the outer edge 64. In the wear surface portion 80 of the liner 54 is a parallelogram-like shaped grooved cutout 82 defined by a pair of spaced apart circumferential groove portions 84 which connects with a pair of spaced apart angularly positioned groove portions 86. In the wear surface portion 80 of the wear liner 56 is an H-like shaped grooved cutout 86. This latter grooved cutout 86 comprises a pair of spaced apart circumferential groove portions 88 joined by a connecting groove portion 90. The projection 74 and grooved cutout 86 of the liner 56 are in proximate alignment.

The wear liners 54, 56 may be made as a casting or forging. A preferred material for the liners 54, 56 is one which is heat treatable to be initially ductile then subsequently work hardenable. Two low carbon steels found to have these qualities are identified as either an Austempered nodular unalloyed iron or the American Society of Testing and Material designation ASTM A-128 Austenitic manganese steel.

Again referring to FIGS. 1–3, the gear assembly 10 further includes a spring package 94 which may comprise a set of stacked elastomeric pads 96. The spring package 94 is compressively held between the end wall 24 and a moveable follower 98. The follower 98 in turn has an outer end 100 engaging inner walls 102 of a set of three friction shoes 104.

Each friction shoe 104 is made of a steel having a Brinell hardness of about 463. An outer friction surface 106 of the shoes 104 has a shallow V-like shaped configuration of complementary angularity to that of housing friction bore shoe seats 36–40 respectively to engage the wear surface portions 80 of the wear liners 54, 56. Hereinafter only the wear liner 54 may be referred to, but it should be understood that the wear liner 56 would function in the same way to produce similar results.

Note that each friction shoe friction surface 106 also is in contract with a lubricating insert 108 which is formed to fit in the parallelogram shaped grooved cutout 82 of the wear liner 54 or formed to fit in the H-shaped grooved cutout 86 of the wear liner 56. Use of such inserts 108 is discussed in detail in co-pending patent application USSN. No. 583,915 filed Feb. 27, 1984 which herein is incorporated by reference.

Projecting outwardly through an opening 110 defined by the friction bore section front wall 44 is an outer end 112 of a wedge 114. This outer end 112 may connect or engage with other components of the coupler system. The wedge 114 further includes a set of three lugs 116 positioned behind and in alignment with three stops 118 formed on the housing friction bore section front wall 44 to project into the opening 110. Additionally, the wedge 114 has sloped wedging surfaces 120 engaging sloped walls 122 on the friction shoes 104.

As noted earlier, the housing 12 and wear liners 54 typically are castings and as such may have dimensional variations, for example $\frac{1}{8}$ in. or more. Because of these dimensional variations a fit between the wear liners 54 and the housing friction bore section recesses 42 is initially quite inexact. As such, the wear liner raised areas 68 do not fit snugly in the recess cutouts 50 nor do the edges 62, 72 of the liners 54 fit tightly against the recess inner circumferential shoulders 46 or sides 48 respectively.

During first use of the draft gear assembly 10 in the railroad car coupler system, impacting forces are transferred from a coupler head (not shown) to the wedge 114 to move the wedge 114 toward the housing end wall 24. Concurrent with this longitudinal wedge movement, the wedge 114 forces the friction shoes 104 radially apart so that the shoe friction surfaces 106 compressively engage the wear surface portions 80 of the wear liners 54. In their ductile condition the magnitude of this compressive force is sufficient to deform the liners 54. This deformation results in a permanent set of the wear liners 54 producing a snug-like fit between the liner edges 62, 72 and the liner raised areas 68 and the friction bore section recess inner shoulders 46, sides 48 and cutouts 50. Additionally, other areas of non-contact between the liner outer faces 66 and other surfaces of the recesses 42 are reduced. Thus, the wear liners 54 become snugly fitted and properly seated in the housing recesses 42 to secure a location of the liners 54 during subsequent car operation.

The above noted permanent deformation of the wear liners 54 also improves the fit between friction surfaces 106 of the shoes 104 and the wear surface portions 80 on the wear liners 54 respectively. Again, as initially manufactured, dimensional variations may result in mismatches between the surfaces 80, 106 to produce areas of non-contact. As deformed, the size of any non-engaging areas is reduced substantially. Thus, as subsequent impacting forces drive the wedge 114 inward to force the shoes 104 to frictionally slide over the wear liners 54 and move the follower 98 to compress the spring package elastomeric pads 96, the improved fit between the shoes 104 and the liner wear surface portions 80 reduces the rate of wear therebetween.

As the wear liners 54 are further impacted by the shoes 104, the liners 54 are work hardened to a Brinell hardness level approximating 363. This level of liner hardness is about 100 points less than that of the shoe friction surfaces 106. At this hardness level differential abrasive wear of the liner wear surface portions 80 is at a minimum. Abrasive wear occurs when bits of material dislodge from the liner surface portions 80 and become affixed to the shoe friction surfaces 106. Thus, the rate of material wearing away from the surfaces 80, 106 is reduced to still further extend the useful life of the gear assembly 10 before the assembly 10 requires major maintenance.

Note that during a major reconstruction of the gear assembly 10, the then worn liners 54 may be removed and replaced by a new set. Unless wear is allowed to continue to a point where the shoes 104 engage housing portions of the friction shoe seats 36–40, the useful life the housing 12 is substantially prolonged.

While embodiments of this invention have been shown and described, it should be understood that this invention is not limited hereto except by the scope of the claims. Various modifications and changes may be made without departing from the scope and spirit of the invention as the same will be understood by those skilled in the art.

What I claim is:

1. A draft gear assembly for a railroad car coupler system to absorb and cushion impacting forces placed on the system during operation of said car, the improvement therein comprising:

wear liner means to interact with a friction shoe carried by said assembly and moveable by said impacting forces, said liner means disposable in a recess formed in a housing of said gear assembly with said liner means initially deformed by said impacting forces transferred from said shoe to said liner means to increase areas of contact between said shoe and said liner means and between said liner means and said housing recess and work hardened to an operative Brinell hardness level of about 365 being about 100 Brinell points less than a hardness level of said shoe, wherein said deformability of said liner means reduces dimensional mismatches between said shoe, said liner means and said housing recess to improve seating therebetween, improves wear resistance between said shoe and said liner means and inhibits movement of said liner means during subsequent car operation, and said different levels of hardness of said liner means in said work hardened state and said shoe reducing abrasive wear therebetween.

2. A draft gear assembly as defined by claim 1 and further characterized by, said liner means having an inner face comprising a wear surface portion formed with a parallelogram-like grooved cutout for disposition of a like shaped lubricating insert and having an outer face formed with a peripheral rib to fit in a like shaped cutout formed in said housing recess.

3. A draft gear assembly as defined by claim 1 and further characterized by, said liner means having an inner face comprising a wear surface portion formed with an H-like shaped grooved cutout for disposition of a lubricating insert and having an outer face formed with an H-like shaped projection to fit in a like shaped cutout in said housing recess.

4. A draft gear assembly particularly adapted for a railroad car coupler system, said assembly comprising:

a housing having an inner section defined by a pair of spaced apart sidewalls joined by a top and a bottom wall and connecting with an end wall to form an interior space with a spring package disposed therein, and an outer friction bore section connecting with said inner section and defined by sidewalls set in a hexagon array, a set of friction shoe seats formed in part by adjacent pairs of inner surfaces of said friction bore sidewalls joining at a radius corner and a recess aligned with said radius corner, said recess extending from a front wall of said outer section to an inner circumferential shoulder located next to said housing inner section with each said recess formed with a cutout, a set of wear liners each having on an outer face a raised area to fit in said recess and said recess cutout respectively with said liners having an inner face with an operative Brinell hardness level of about 363 points, a set of friction shoes positioned one each on said wear liners with each said shoe having a friction surface in contact with a wear surface portion on said inner face of said liner with said shoe friction surface having a Brinell hardness level about 100 points greater than said wear liner inner face wear surface portion, and a wedge having an outer end extending beyond said housing front wall and wedging surfaces in contact with sloped walls of said friction shoes, wherein impacting forces on said coupler system are transferred to said wedge to move said shoes in a first direction toward said housing end wall to compress said spring package and in a second direction to move said shoes radially apart to compressively engage said liners with said hardness level differential between said liner inner face wear portions and said shoe friction surfaces inhibiting abrasive wear therebetween to extend a useful life of said draft gear.

5. A draft gear assembly as defined by claim 4 and further characterized by, said liner wear surface portion formed with a grooved cutout, and a lubricating insert positioned in said grooved cutout to interface with said friction shoe friction surface.

6. A draft gear assembly as defined by claim 5 and further characterized by, said liner grooved cutout having a parallelogram-like shape defined by a pair of spaced apart circumferential groove portions connection with a pair of spaced apart angularly offset groove portions.

7. A draft gear assembly as defined by claim 5 and further characterized by, said liner grooved cutout having an H-like shape defined by a pair of spaced apart circumferential groove portions joining a connecting groove portion.

8. A draft gear assembly as defined by claim 7 and further characterized by, said liner raised area comprising an H-like shaped projection positioned to align with said grooved cutout, and said housing recess cutout shaped to receive said liner projection in a complementary manner.

9. A draft gear assembly as defined by claim 4 and further characterized by, said liners having an initial hardness level to allow an initial set of said impacting forces to deform said liners and promote a fit between said shoes, said liners, and said housing recesses respectively by reducing areas of non-engagement therebetween with said impacting force initial set effecting a workhardening of said liners to said operative hardness level.

* * * * *